US005555641A

United States Patent [19]

Lee

[11] Patent Number: 5,555,641

[45] Date of Patent: Sep. 17, 1996

[54] DEVICE AND METHOD FOR CONTROLLING DRYING PERIOD OF TIME OF A LAUNDRY DRYER

[75] Inventor: In K. Lee, Seoul, Rep. of Korea

[73] Assignee: Goldstar Co., Ltd., Seoul, Rep. of Korea

[21] Appl. No.: 179,869

[22] Filed: Jan. 11, 1994

[30] Foreign Application Priority Data

Jan. 11, 1993 [KR] Rep. of Korea ..... 1993-274

[51] Int. Cl.[6] ..... F26B 3/34

[52] U.S. Cl. ..... 34/261; 34/486; 34/495

[58] Field of Search ..... 34/259, 260, 261, 34/493, 494, 495, 496, 486, 549, 595

[56] References Cited

U.S. PATENT DOCUMENTS 4,795,871 1/1989 Strattan et al. ..... 34/259

5,315,765 5/1994 Holst et al. ..... 34/260

5,325,600 7/1994 Gentile ..... 34/260

*Primary Examiner*—Henry A. Bennett

*Assistant Examiner*—Susanne C. Tinker

*Attorney, Agent, or Firm*—Spencer & Frank

[57] ABSTRACT

This invention relates to a control of drying period of time of a laundry dryer which is provided to use the microwave generated from a magnetron and the heat generated from a heater efficiently, and allows to dry every nook and corner of laundry within a short period of time by utilizing that the dielectric loss coefficient of water compared with that of textile is greater only using the microwave of the magnetron in the initial stage of drying operation, and allows to prevent damages to clothes as well as a uniform drying by carrying out drying operation altering the heat source from the microwave to heater and vice versa permitting to dry uniformly due to the steam of the textile flowing smoothly on progression of the drying operation, and improvement of dryness by using only the heat of the heater again within the drying finish section.

4 Claims, 5 Drawing Sheets

DEVICE AND METHOD FOR CONTROLLING DRYING PERIOD OF TIME OF A LAUNDRY DRYER

FIELD OF THE INVENTION

This invention relates to a control of drying period of time of a laundry dryer, more particularly to a device and method for controlling drying period of time of a laundry dryer which is provided to use the microwave generated from a magnetron and the heat generated from a heater efficiently.

BACKGROUND OF THE INVENTION

As shown in FIGS. 1 and 2, a conventional laundry dryer includes a function control part 7 provided on the front surface of outcase 3 having a power switch 4 and a run/pause button 5 to input the function of a laundry dryer, a motor 6 mounted on the upper part of inside the outcase rotating a drum 1 according to the switching of the power switch 4 and the run/pause switch 5, a heater 2 mounted on a side inside of the outcase 3 for drying laundry, a drum temperature sensing part 8 provided outside of the drum 1 for sensing the inside temperature of the drum 1, a heat exchange fan 11 installed inside of the outcase 3, driven by the motor 6, cooling moist laden warm air inside of the outcase 3 by drawing in outside air through an air drawing in hole 15 and discharging warm air drawn from inside of the drum 1 to a discharge hole 14 in a drying passage 13, a discharge air temperature sensing part 9 sensing a discharge air temperature of the air discharged to the drying passage 13 of the outcase 3, an environment temperature sensing part 10 provided rear of the heat exchanger fan 11 sensing the temperature of the air drawn from the environment, a filter 12 filtering the air drawn-in from outside by the heat exchange fan 11 and a door 16 provided on the front of the outcase 3 for taking out laundry therethrough.

A conventional laundry dryer explained above is operated as follows;

When, after putting wet laundry into the drum 1 through the door 16 to dry wet laundry, a drying operation is carried out by turning on the power switch 4 and pressing the run/pause button 5 on the function control part 7. The motor 6 mounted on the upper part inside of the outcase 3 together with the drum 1 and the heat exchange fan 11 driven by the motor 6 start to rotate drawing in air through the air drawing in hole and the heater 2 starts to heat. The outside air drawn-in by the heat exchange fan 11 and passed through the heater 2 dries the laundry in the drum 1 slowly. That is, the warm air heated by the heater 2 vaporizes the moisture contained in the wet laundry in the drum 1 to become warm and humid air, which is delivered to the heat exchange fan 11 through the filter 12 positioned rear of the drum 1. The warm and humid air delivered to the heat exchange fan 11 exchanges heat with the cold air drawn-in from outside through the air drawing-in hole 15 by the heat exchange fan 11, the condensate by the heat exchange is drained through the drying passage 13 and the discharge hole 14, and the low temperature and low humid air after the dehumidification is blown through the drying passage 13 to the heater 2 to be heated again and delivered into the drum 1 to dry the laundry.

In this time, the drum temperature sensing part 8 positioned between the filter 12 and the heat exchange fan 11 senses the temperature T1 of the moist laden warm air which has dried the laundry, the discharge air temperature sensing part 9 senses the temperature T2 of the air after the dehumidification and cooling and the environment temperature sensing part 10 positioned in the rear of the heat exchange fan 11 senses the temperature 13 of the drawn in environment air.

That is, as shown in FIG. 3, the air temperature T1 inside of the drum 1 and the air temperature T2 after the dehumidification and cooling rise rapidly by the heater 2 within a preheat drying section t1 on the initial stage of drying operation while the environmental temperature T3 is the same all the time.

Thereafter, the air temperature T1 inside of the drum 1, the air temperature T2 after the dehumidification and cooling and environmental air temperature T3 do not rise any more maintaining the same temperatures all the time as the vaporization is at full-scale within the drying progression section t2, ie. equilibrium section after the preheat drying section t1.

Then, within the drying finish section t3 after the drying progression section t2, as the drying is almost finished, the air temperature T1 in the drum 1 rises again, the air temperature T2 after the dehumidification and cooling drops again, and the environmental temperature T3 is the same all the time. In this time, a temperature difference ΔT1 between the air temperature T1 in the drum 1 and the air temperature T2 after the dehumidification and cooling is calculated, and when the calculated temperature difference ΔT1 has been reached to preset temperature differences ΔT2 and ΔT3 preset according to the quantity of the laundry, judging that the dryness has been reached to 75%, 100% or more than 100%, the drying operation is finished by turning off the motor 6 and the heater 2.

However, such a conventional laundry dryer has a problem of having much electric power consumption because the heater used is of about 1300 watt capacity and the drying period of time required is normally about 2 to 3 hours. Further the dryer has a problem of damage of melting or heat deformation to some kind of laundry(especially wool and nylon) due to a drying temperature of about 60 degrees C. to 70 degrees C.

SUMMARY OF THE INVENTION

The object of this invention is to provide a device and method for controlling drying period of time of a laundry dryer which can shorten drying period of time by improving heat efficiency utilizing microwave.

Another object of this invention is to provide a device and method for controlling drying period of time of a laundry dryer which can prevent damage to laundry and can dry even minute parts of fiber, utilizing microwave.

These and other objects and the features of this invention can be achieved by providing a device for controlling drying period of time of a laundry dryer including analogue/digital converting means for converting analogue signals for a sensed internal drum temperature, discharging air temperature after a dehumidification and a cooling, and environmental temperature into digital signals, a system control means for controlling all the system operations in response to the output signals from the analogue/digital converting means, a lead driving means for supplying driving power switched by the system control means, a high voltage transformer for elevating an input power voltage to a required high voltage by the driving power of the lead driving means, a magnetron controlled by the lead driving means for generating microwave by means of the high voltage of the high voltage transformer, a cooling fan directly coupled to a motor which is also driving the drum for drawing-in and cooling the heat of the high voltage transformer and the magnetron, and a heat transfer means for transferring the microwave generated in the magnetron to laundry in the drum.

Another object of this invention can be achieved by providing a method for controlling drying period of time of a laundry dryer including, in a drying operation, a preheat drying process for carrying out drying operation by driving a magnetron and a motor until a temperature difference between the temperatures of a high temperature and high humid air in a drum and an air after a dehumidification and cooling becomes constant in the drying operation, an equilibrium drying process for carrying out drying operation until the temperature difference between the temperatures of the high temperature and high humid air and the air after the dehumidification and cooling rises by turning on/off the magnetron and the heater alternatively when the temperature difference between the temperatures of the high temperature and high humid air and the air after the dehumidification and cooling is constant in the preheat drying process, and a drying finish process for carrying out the drying operation by turning off the magnetron and driving only the heater when the air temperature difference starts to rise and finishing the drying operation when the risen air temperature difference reaches to a preset air temperature difference.

BRIEF DESCRIPTION OF THE DRAWINGS

FIG. 5(B) shows output changes of a magnetron according to a lapse of drying time.

FIG. 5(C) shows output changes of a heater according to a lapse of drying time.

DETAILED DESCRIPTION OF THE INVENTION

Figure 1:
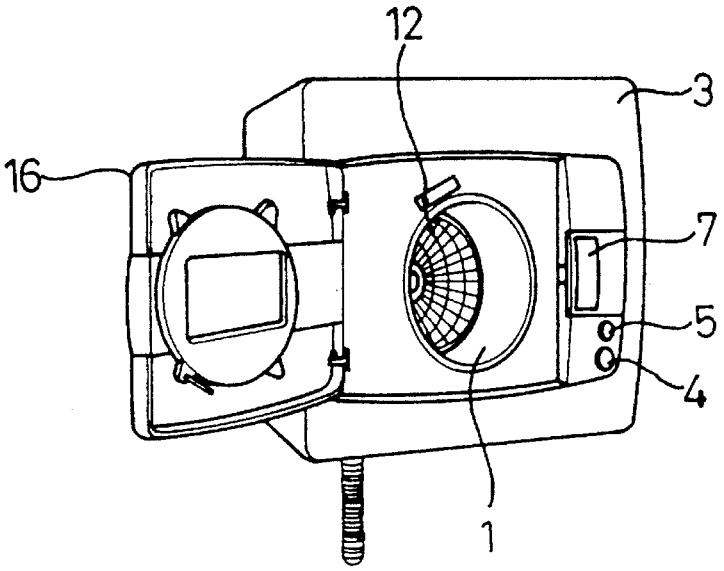
FIG. 1 PRIOR ART
FIG. 1 shows a schematic outside view of a conventional laundry dryer.
Figure 2:
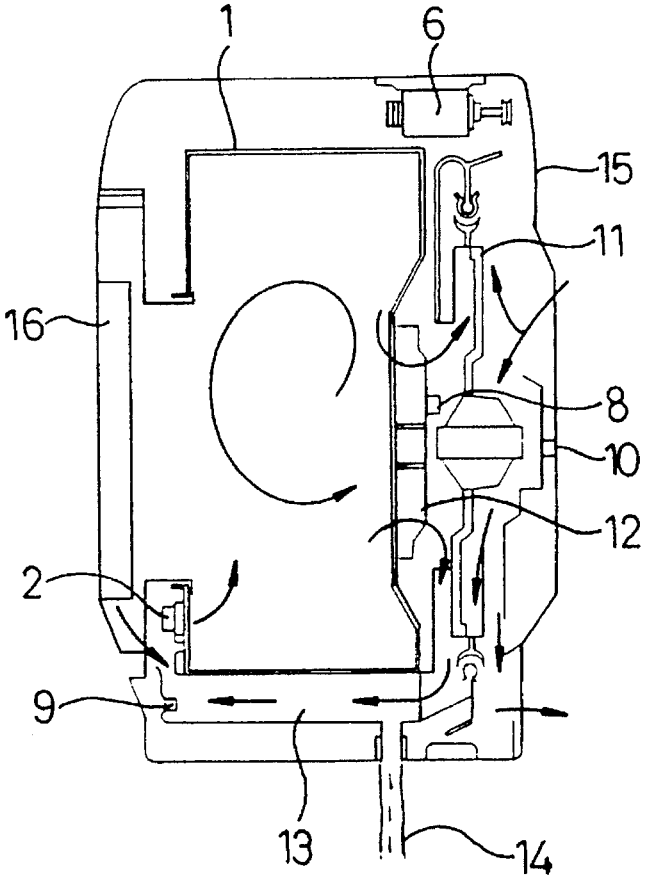
FIG. 2 PRIOR ART
FIG. 2 shows an internal view of the laundry dryer in FIG. 1.
Figure 3:
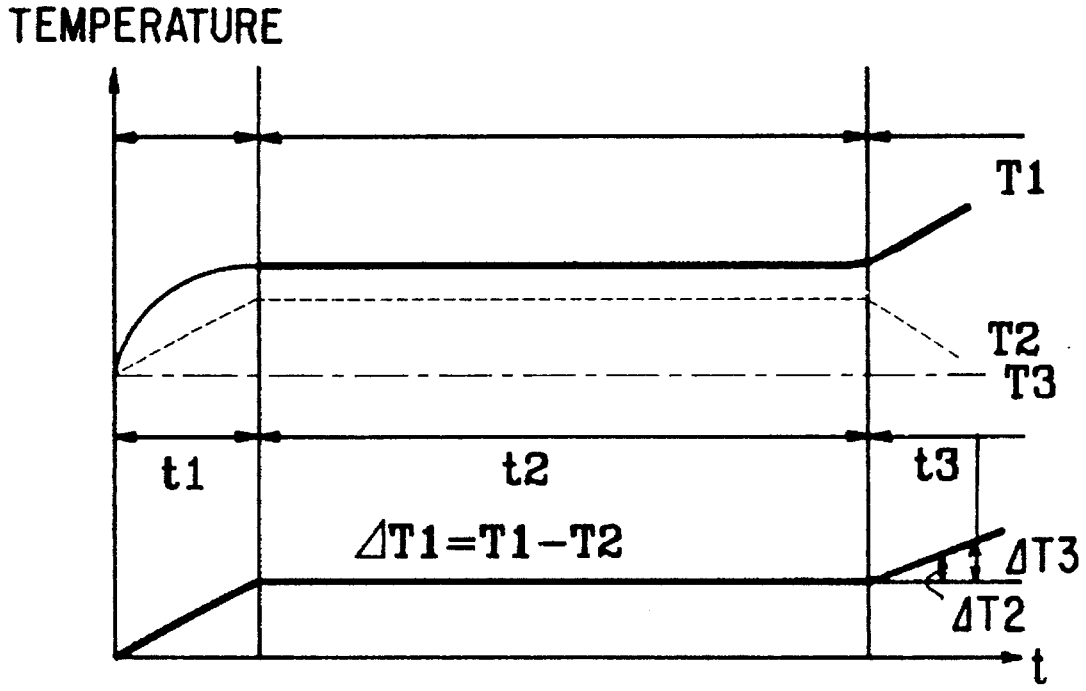
FIG. 3 is a characteristic curve of temperature changes according to a lapse of time for the laundry dryer in FIG. 2.
Figure 4:
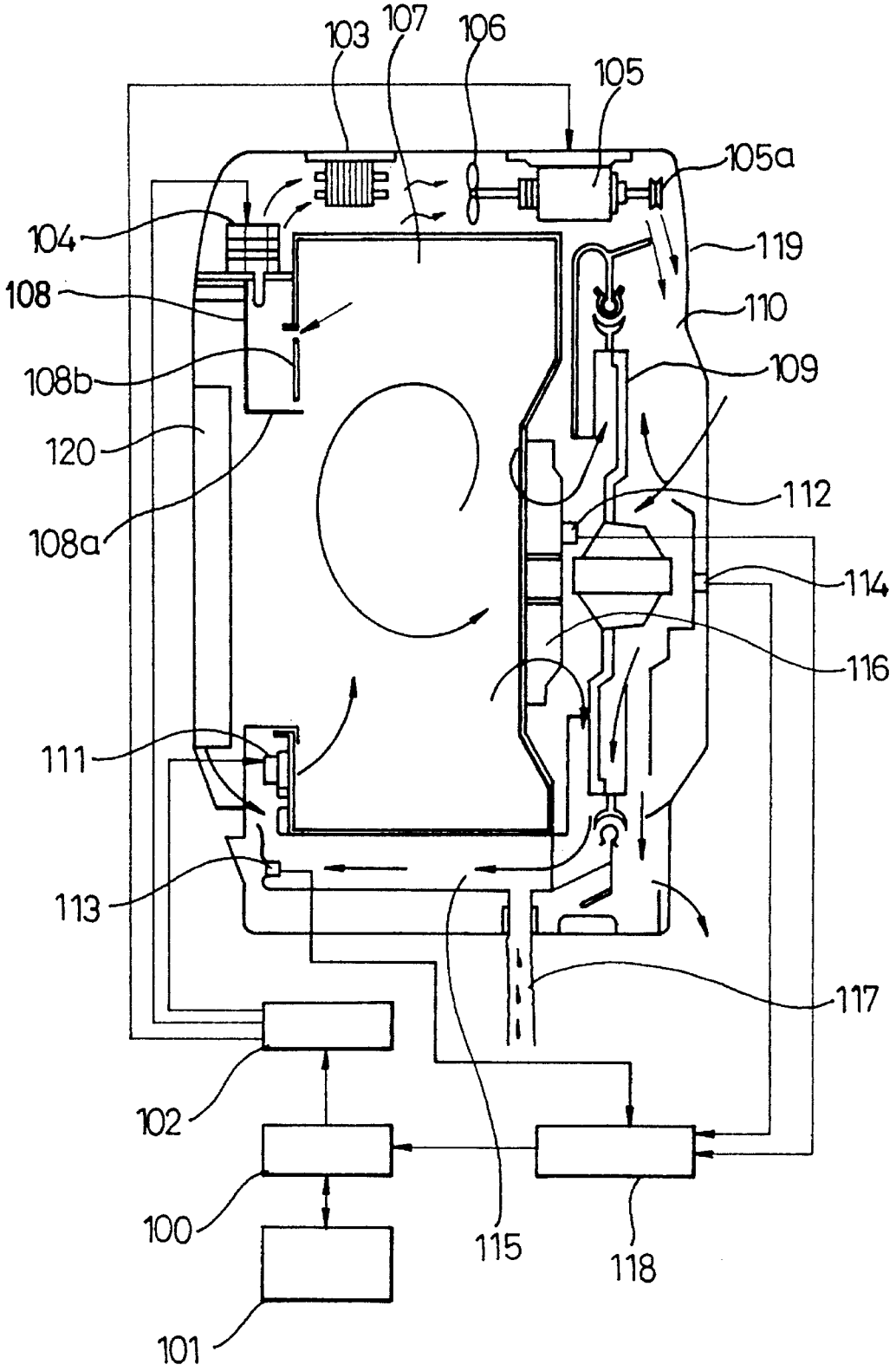
FIG. 4 shows an overall outside view of a laundry dryer in accordance with this invention.

FIG. 4 shows an overall outside view of a laundry dryer in accordance with this invention including a key pad 101 for input of various functions in drying operation, a system control part 100 for controlling all system functions of the laundry dryer in response to the key signals of the key pad 101, a lead operation part 102 for supplying operation power to each loads switched by the control signals of the system control part 100, a high voltage transformer 103 mounted on an upper part inside of an outcase 110 for elevating a input power voltage to a high voltage by the operation power voltage of the lead operation part 102, a motor 105 mounted on the upper part inside of the outcase 110 for rotating a drum 107 by transmission of a rotating power thereto through a pulley 105*a* thereon motivated by the operation power voltage of the lead operation part 102, a magnetron 104 for generating microwave controlled by the lead operation part 102 and driven by the high voltage of the high voltage transformer, a heat transfer part 108 having a waveguide 108*a* and a transparent plate 108*b* transmitting the microwave generated in the magnetron 104 to the laundry in the drum 107, a cooling fan 106 for drawing-in and cooling heats of the high voltage transformer 103 and the magnetron 104 rotated by the motor 105, a heater 111 for drying the laundry in the drum 107 driven by the operation power voltage of the lead operation part 102, a drum temperature sensing part 112 provided outside of the drum 107 for sensing inside temperature of the drum 107, a heat exchange fan 109 mounted in the outcase 110 for cooling moist laden warm air in the outcase 111 by drawing-in outside air through an air drawing-in hole 119 and discharging warm air from the drum 107 to a discharge hole 117 in a drying passage 115 driven by the motor 105, a discharge air temperature sensing part 113 for sensing an air temperature of the air discharged to the drying passage 115 of the outcase 110 after a dehumidification and cooling, a filter 116 for filtering the environment air drawn-in by the heat exchange fan 109, an environment temperature sensing part 114 for sensing an environment temperature drawn-in by the heat exchange fan 109, an analogue/digital converting pan 118 for converting analogue signals of the sensed air temperatures by the drum temperature sensing part 112, the discharge air temperature sensing part 113 and the environment temperature sensing part 114 into digital signals to input to the system control part 110 and a door 120 provided in the front surface of the outcase for putting in and taking out the laundry of the drum 107.

Figure 5:
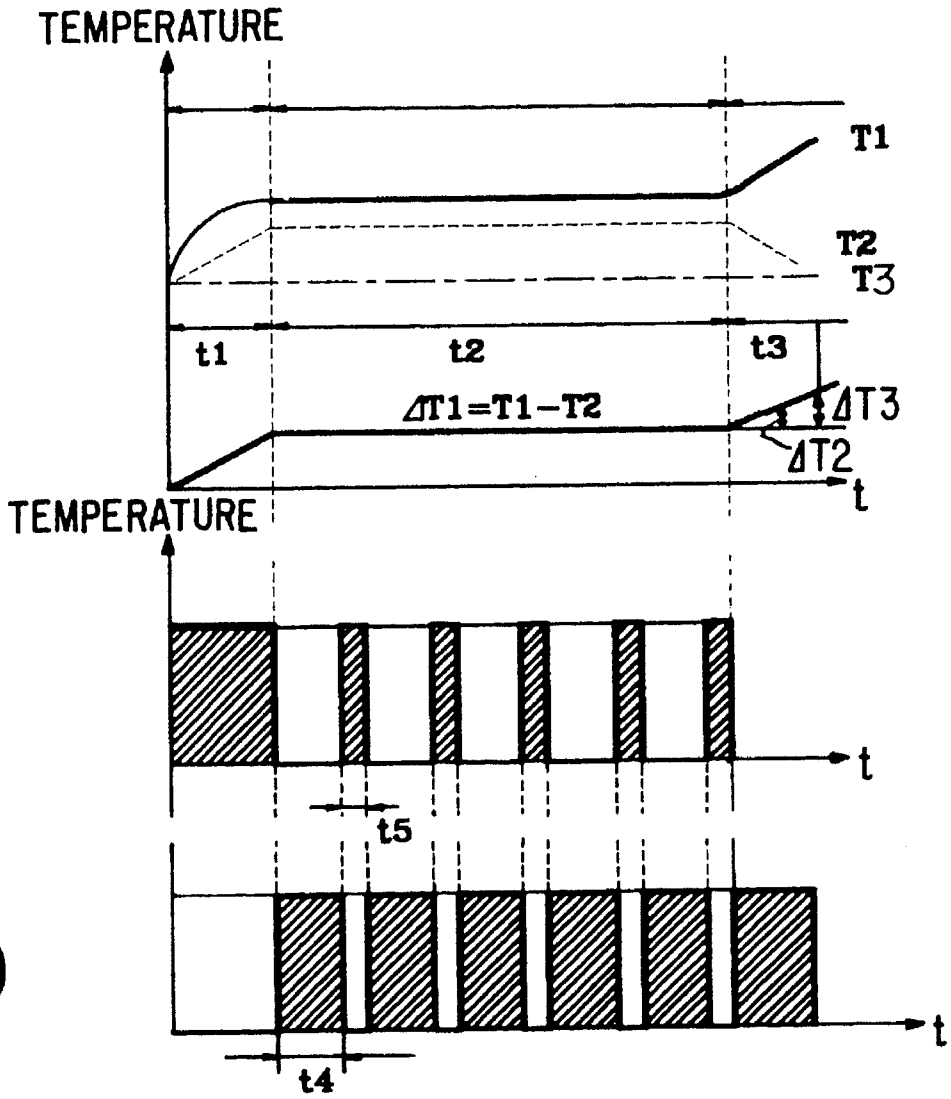
FIG. 5 show characteristic curves of various part during an operation of a laundry dryer shown in FIG. 4 wherein, FIG. 5(A) show temperature changes of drum inside, discharge air and environmental air according to a lapse of drying time.
Figure 6:
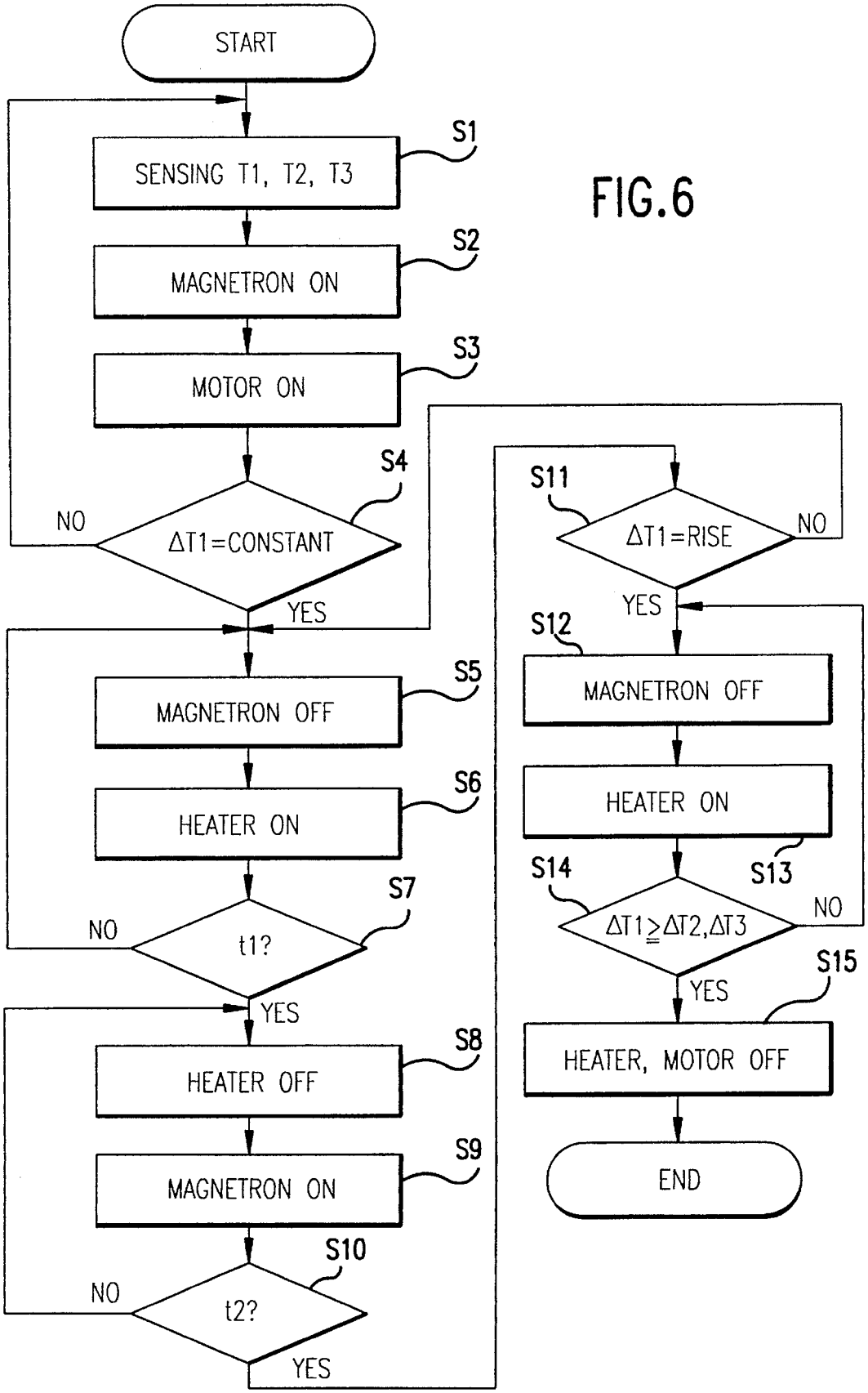
FIG. 6 shows a flow chart explaining the operation of a laundry dryer shown in FIG. 4.

The operation and the advantage of a laundry dryer in accordance with this invention is to be explained in detail, referring to FIGS. 4, 5 and 6.

When an user opens the door 120, puts in wet laundry into the drum 107 to dry laundry, and presses a laundry drying starting key on the key pad 101, at the initial stage the system control part. 100 senses the high temperature and high humid air temperature T1 inside of the drum 107 from the drum temperature sensing part 112, the air temperature T2 after the dehumidification and cooling from the discharge air temperature sensing part 113, and an environment temperature T3 from the environment temperature sensing part 114 (step S1).

That is, on starting of a drying operation at the initial stage, the drum temperature sensing part 112, the discharge air temperature sensing part 113 and the environment temperature sensing part 114 sense the air temperatures of inside of the drum 107, of the drying passage and of the environment, and after convening these temperatures into corresponding electrical signals and further converting these electrical signals into digital signals through the analogue/digital converting part 118, input the signals to the system control part 100, and the system control part 100, after sensing the present initial temperatures through the analogue/digital converting part 118, drives the high voltage transformer 103, the magnetron 104 and the motor 105 through the lead operation part 102 during the preheat drying period of time as shown in FIG. 6 to carry out a first stage drying operation (preheat drying operation) (steps S2 and S3). Accordingly, the high voltage transformer 103 applies a high voltage elevated therein to the magnetron 104, and in turn the magnetron 104 generates microwave by the operation voltage from the lead operation part 102 and the high voltage from the high voltage transformer 103.

The microwave generated in the magnetron 104, passing through the waveguide 108 and the transparent plate, elevates the temperature inside of the drum 107 gradually to dry the laundry, the motor 105 rotates the cooling fan 106 by the operation power voltage of the lead operation part 102 as well as the drum 107 and the heat exchange fan 109 through the pulley 105*a*, and the cooling fan 106 rotated by the motor 105 draws-in and cools down the heat generated in the magnetron and the high voltage transformer. Thus, within the preheat drying section t1, the high temperature air heated by the magnetron 104 is changed to the high temperature and high humid air through a vaporization of the moist contained in the wet laundry inside of the drum 107, and the high temperature and high humid air is drawn to the heat exchange fan 109 through the filter 116 positioned at the center of the rear of the drum 17. The high temperature and high humid air drawn to the heat exchange fan 109 exchanges heat with the cold air drawn-in from the environment through the air drawing in hole 119 by the heat exchange fan 109, the condensate by the heat exchange is drained through the drying passage 115 and the discharge hole, and the low temperature and low humid air after the dehumidification is blown into the drum 107 again through the drying passage 115 to dry laundry.

In this time, the system control part 100, detecting the high temperature and high humid air temperature T1 from the drum temperature sensing part 112 and the air temperature T2 after the dehumidification and cooling from the discharge air temperature sensing part 113 through the analogue/digital converting part 118, finishes the first stage drying operation (the preheat drying operation) when the temperature difference ΔT1 of the two air temperatures T1 and T2 is constant (step S4), judging that the drying has been progressed to a certain level, and carries out a second stage drying operation by turning on/off the magnetron 104 and the heater 111 alternatively through the lead operation part 102 during the equilibrium drying operation section t2 (steps S5 to S10). That is, within the equilibrium drying operation section t2, the magnetron 104 is turned off and the heater 111 is turned on for a certain period of time t4 to dry the laundry as shown in FIG. 5(*c*), then, after the certain period of time t4, the heater 111 is turned off and the magnetron 104 is operated for a certain period of time t5 to dry the laundry as shown in FIG. 5(B), wherein the relation between the turn-on periods of time of the heater t4 and the magnetron t5 is t4>t5, for example t4=52 sec., t5=8 sec. Thus, within the equilibrium drying operation section, the heater 111 and the magnetron 104 is switched alternatively to dry the laundry until the temperature difference ΔT1 between the temperatures of the high temperature and high humid air T1 sensed by the drum temperature sensing part 112 and the air T2 after the dehumidification and cooling sensed by the discharge air temperature sensing part 112 rises (step S11), when the second drying operation is finished and a third stage drying operation is carried out by turning on the heater 111 until drying operation finish time t3. That is, within the third stage drying operation, the magnetron 104 is turned off while the heater 111 only is turned on to operate for a certain period of time to dry the laundry as shown in FIG. 5(B) (steps S12 and S13).

Thereafter, within the third stage drying operation, the heater 111 as well as the motor 105 are turned off to finish the third stage drying operation(steps S14 and S15), when the temperature difference ΔT1 between the temperatures of the high temperature and high humid air T1 sensed by the drum temperature sensing part 112 and the air T2 after the dehumidification and cooling is the same or greater than the preset temperature differences ΔT2 and ΔT3 preset according to the quantity of the laundry.

As explained herein, this invention allows to dry every nook and corner of laundry within a short period of time by utilizing the fact that the dielectric loss coefficient of water compared with that of textile is greater, only using the microwave of the magnetron in the initial stage of drying operation, and allows to prevent damages to clothes as well as a uniform drying by carrying out drying operation altering the heat source from the microwave to heater and vice versa permitting to dry uniformly due to the steam of the textile flowing smoothly on progression of the drying operation, and improvement of dryness by using only the heat of the heater again within the drying finish section.

Although the invention has been described in conjunction with specific embodiments, it is evidence that many alternatives and variations will be apparent to those skilled in the art in light of the foregoing description. Accordingly, the invention is intended to embrace all of the alternatives and variations that fall within the spirit and scope of the appended claims.

What is claimed is:

1. A method for controlling drying period of time of a laundry dryer comprising:

a preheat drying process for carrying out drying operations by driving a magnetron and a motor until a temperature difference between a first air temperature of a high temperature and high humid air in a drum and a second air temperature after a dehumidification and cooling becomes constant in the drying operation;

an equilibrium drying process for carrying out drying operation until the temperature difference between the first air temperature and the second air temperature rises by turning on/off the magnetron and a heater alternatively when the temperature difference between the first air temperature and the second air temperature is constant;

a drying finish process for carrying out the drying operation by turning off the magnetron while driving the heater only when the air temperature difference between the first air temperature and the second air temperature starts to rise and finishing the drying operation when the risen air temperature difference reaches to a preset air temperature differences preset according to a quantity of the laundry;

wherein the alternative turn on/off period of time of the magnetron and the heater in the equilibrium drying process is different; and wherein the period of a turn-on time of the heater is set longer than the period of the turn-on time of a magnetron.

2. A device for controlling drying period of time of a laundry dryer comprising:

analogue/digital converting means for converting analogue signals for a sensed internal drum temperature, discharging air temperature after a dehumidification and a cooling, and environmental temperature into digital signals;

system control means for controlling all system operations in response to output signals from the analogue/digital converting means;

load driving means for supplying driving power switched by the system control means;

a high voltage transformer for elevating an input power voltage to a required high voltage by the driving power of the load driving means;

a magnetron controlled by the load driving means for generating microwave by means of the high voltage of the high voltage transformer;

a cooling fan directly coupled to a motor which is also driving a drum for drawing-in and cooling heat from the high voltage transformer and the magnetron;

heat transfer means for transferring the microwave generated in the magnetron to laundry in the drum;

wherein the alternative turn on/off period of time of the magnetron and the heater in the equilibrium drying process is different; and wherein the period of a turn-on time of the heater is set longer than the period of the turn-on time of a magnetron.

3. A device as claimed in claim 2, wherein the heat transfer means includes a waveguide and a transparent plate transmitting the microwave generated in the magnetron to laundry in the drum.

4. A method for controlling drying period of time of a laundry dryer comprising:

a preheat drying process for carrying out a drying operation for drying a quantity of laundry by driving a magnetron and a motor until a temperature difference between a first air temperature of a high temperature and high humid air in a drum and a second air temperature after a dehumidification and cooling becomes constant in the drying operation;

an equilibrium drying process for carrying out the drying operation until the temperature difference between the first air temperature and the second air temperature rises by a turning on/off of the magnetron and a heater alternatively when the temperature difference between the first air temperature and the second air temperature is constant, the turning on/off producing an on cycle time of the magnetron alternating with an on cycle time of the heater, the on cycle time of the heater set to have a longer duration than the on cycle time of the magnetron; and a drying finish process for carrying out the drying operation by turning off the magnetron while driving the heater only when the air temperature difference between the first air temperature and the second air temperature starts to rise and finishing the drying operation when the risen air temperature difference reaches to a preset air temperature differences preset according to the quantity of the laundry.

* * * * *